United States Patent [19]

Koizumi et al.

[11] Patent Number: 4,532,393

[45] Date of Patent: Jul. 30, 1985

[54] PUSH BUTTON SWITCH

[75] Inventors: Haruyuki Koizumi; Zenichi Kitao; Hideki Sato, all of Nagaokakyo, Japan

[73] Assignee: Omron Tateisi Electronics, Co., Kyoto, Japan

[21] Appl. No.: 614,388

[22] Filed: May 25, 1984

Related U.S. Application Data

[63] Continuation of Ser. No. 518,046, Jul. 28, 1983, abandoned.

[30] Foreign Application Priority Data

Jul. 30, 1982 [JP] Japan ..... 57-116385[U]

[51] Int. Cl.[3] ..... H01H 13/52; H01H 9/18

[52] U.S. Cl. ..... 200/159 R; 200/317; 200/330; 200/340

[58] Field of Search ..... 200/153 T, 159 R, 307, 200/314, 317, 330, 332, 335, 340

[56] References Cited

U.S. PATENT DOCUMENTS

| | | | |
|---|---|---|---|
| 2,503,409 | 4/1950 | Platz et al. | 200/332 |
| 2,925,482 | 2/1960 | Bonanno | 200/317 |
| 3,155,807 | 11/1964 | Wiley | 200/332 |
| 3,238,343 | 3/1966 | Carlson | 200/330 |
| 3,689,724 | 9/1972 | Labude et al. | 200/330 |
| 3,946,171 | 3/1976 | Kuhfus | 200/330 |
| 4,267,417 | 5/1981 | Koepke | 200/317 |
| 4,306,123 | 12/1981 | Taylor | 200/307 |
| 4,367,384 | 1/1983 | Waarle | 200/159 B |

FOREIGN PATENT DOCUMENTS

| | | | |
|---|---|---|---|
| 2503446 | 10/1982 | France | 200/314 |
| 903373 | 8/1962 | United Kingdom | 200/314 |
| 1195424 | 6/1970 | United Kingdom | 200/153 T |

*Primary Examiner*—John W. Shepperd

*Attorney, Agent, or Firm*—Wegner & Bretschneider

[57] ABSTRACT

A push button switch is disclosed which includes a switching body which works as it is, a holder supporting the switching body on one end wall thereof, and a key top swingably mounted on the holder, in which the switching body, the holder and the key top are assembled as a single unit and can be manually disassembled.

6 Claims, 8 Drawing Figures

PUSH BUTTON SWITCH

This application is a continuation of U.S. application Ser. No. 518,046, filed July 28, 1983, now abandoned.

BRIEF SUMMARY OF THE INVENTION

This invention relates to a push button switch, and more particularly to an improved switch which may be mounted on a printed circuit board.

There is well known a push button switch consisting of a switching body and a housing or a holder supporting the switching body. The housing, however, is constructed to surround a periphery of the switching body, so that the width of the assembled switch has to become wider than that of the supported switching body. This construction is disadvantageous where the switch is required to be minimized.

It is, therefore, a primary object of this invention to provide a push button switch having a minimized construction in scale.

It is a further object of this invention to provide a push button switch consisting of a switching body, a holder supporting the switching body, and a key top swingably supported by the holder, which is easy to assemble and can provide a long mechanical life.

It is a still further object of this invention to provide a push button switch adapted to include a light emitting member or diode.

According to this invention, there is provided a push button switch including a switching body which works as it is, a holder supporting the switching body on one end wall thereof, and a key top swingably mounted on the holder, in which the switching body, the holder and the key top are assembled as a single unit and can be manually disassembled.

Other objects as well as the numerous advantages of the push button switch according to this invention will become apparent from the following detailed description and the accompanying drawings, in which:

DETAILED DESCRIPTION

Figure 1:
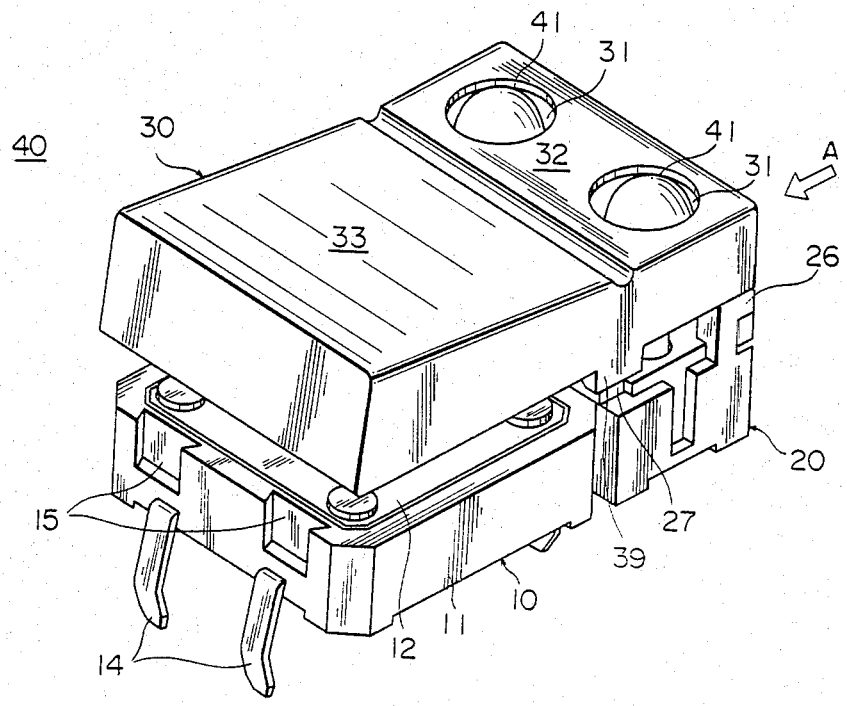
FIG. 1 is a perspective view for illustrating a push button switch which is completely assembled as a preferred embodiment of this invention.
Figure 8:
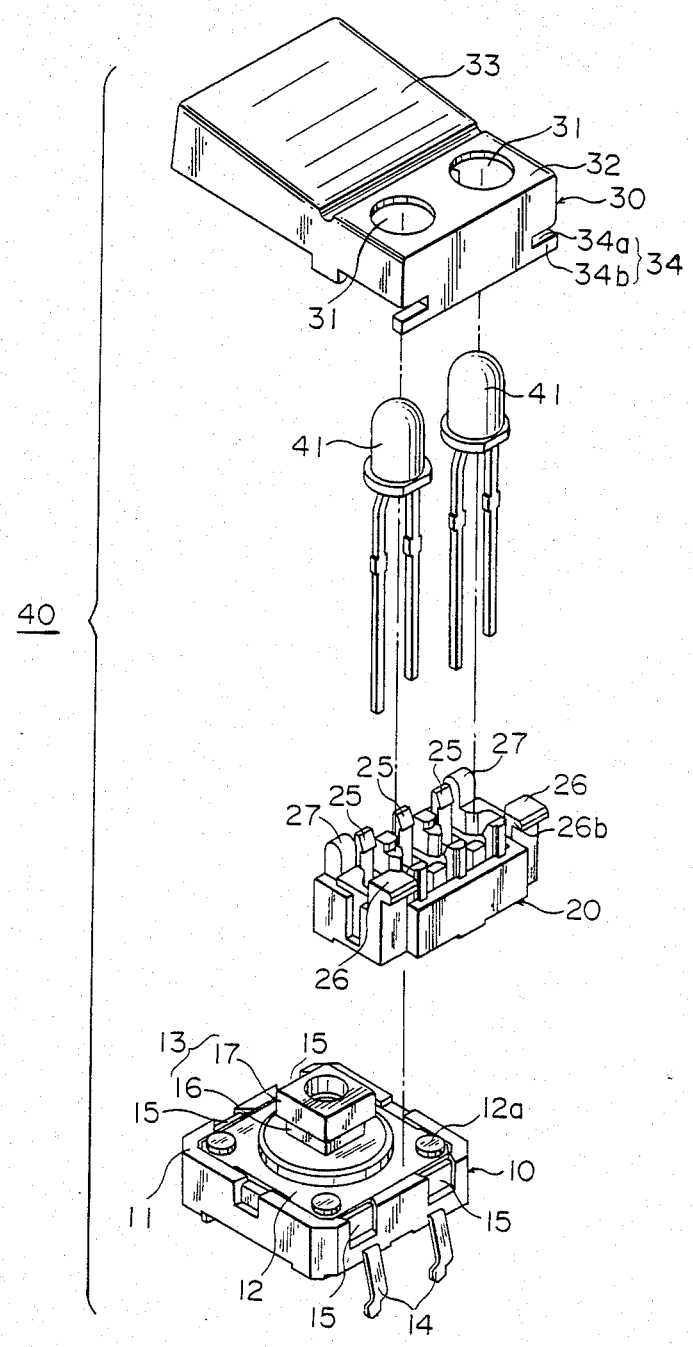
FIG. 8 is a disassembled view of the switch of FIG. 1.

Referring, now, to FIGS. 1 and 8, there is shown a push button switch 40 which includes a switching body 10, a holder 20 supporting the body 10, and a key top 30 actuatable externally, as a preferred embodiment of this invention.

Figure 5:
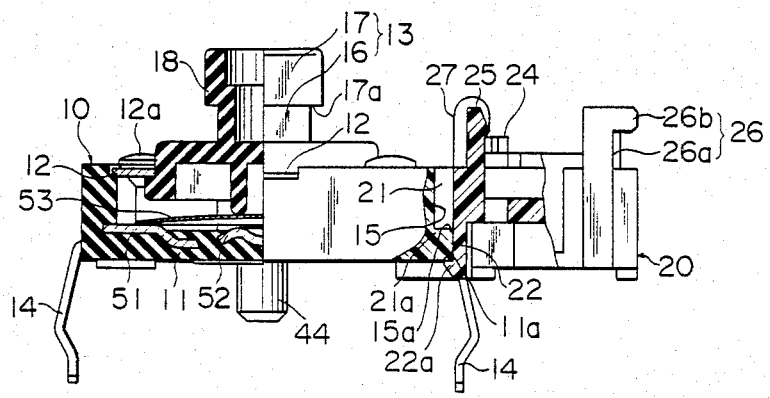
FIG. 5 is a partial sectional side view of the switch of FIG. 4.

The switching body 10 as viewed in FIGS. 5 and 8 is exemplarily constructed such that a base 11 of a square shape is formed of a plastic to house a dome-shaped spring plate 53 bearing a movable contact within the base 11, and a push button 13 is operatively supported between the dome-shaped spring plate 53 and a biassing plate 12 fixed by four posts 12*a*. Four terminals 14 electrically connected with stationary contacts 51 and a terminal 44 electrically connected with the plate 53 are extending downwardly from side walls of the base 11 for mounting on a printed circuit board.

Figure 4:
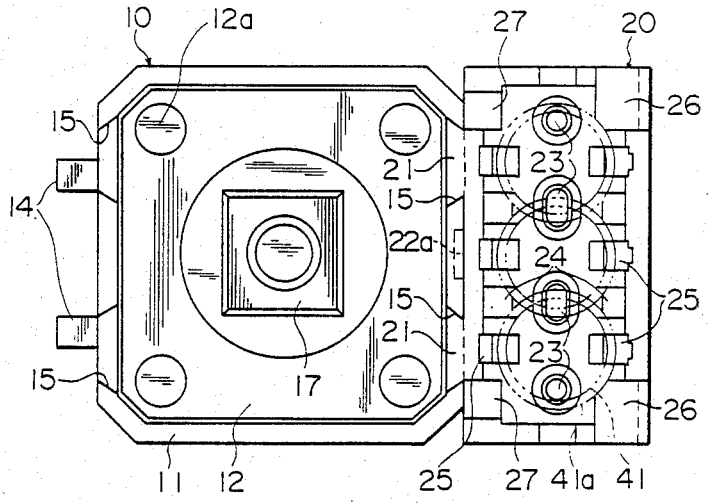
FIG. 4 is a top plan view for illustrating the switch of FIG. 1 with the top key removed.

In upper portions of opposing side walls of the base 11 as viewed in FIG. 4 there are formed two pairs of grooves 15 which are symmetrical with respect to the center of the base 11. The respective grooves 15 are formed such that their external widths are narrower than their inner widths and the respective opposing projections 21 hereinafter described are adapted to be removably meshed with the grooves through upper openings thereof. The push button 13 includes a neck portion 16 projecting upwardly of the base 11 and a head portion 17. The head portion 17 at its lower surface 17*a* has a step portion 18 projecting outwardly from the neck portion 16.

The holder 20 on an upper portion of one side wall thereof includes a pair of projections 21, and a downward clasp 22 therebetween. The projections 21 are removably inserted into the grooves 15 through their upper openings for engagement therewith. Thus, as illustrated in FIGS. 4 and 5, the respective side walls of the base 11 and the holder 20 are engaged with each other in such a manner that lower surfaces 21*a* of the projections 21 come into contact with bottom walls 15*a* of the grooves 15 and a bottom nail end 22*a* of the clasp 22 is engaged with a lower edge 11*a* of the base 11, whereby the engagement between the switching body 10 and the holder 20 is ensured and prevented from disengagement therebetween by external vibrating forces.

On an upper surface of the holder 20 as viewed in FIG. 4 there are formed three mounting portions for light emitting diodes (hereinafter described as "LED") 41 as a light emitting member, each of which includes a pair of terminal inserting holes 23, posts 24 engaging rounded portions 41*a* of the LED, and a pair of clasps 25 supporting the LED by engagement with the rounded portions 41*a*. Therefore, one or two LED's 41 may be mounted on the holder 20. The former may be installed in the middle mounting portion of the holder 20, and the later in the outer two mounting portions thereof. In either mounting, each LED 41 on its rounded portion is fixed in its position by posts 24, and supported by nails 25. In this embodiment, the inner pair of terminal holes 23 represent inner side terminal holes for the two-LED mounting.

The holder 20 on an opposite end thereof further includes a pair of clasps or engaging portions 26 as viewed in FIGS. 4, 5 and 8. The portions 26 have outwardly opened grooves 26*a*. In cooperation therewith, a pair of guide posts 27 are formed on either side upper surfaces of the holder 20 for guiding vertical swing movement of the key top 30 as described hereinafter.

Figure 6:
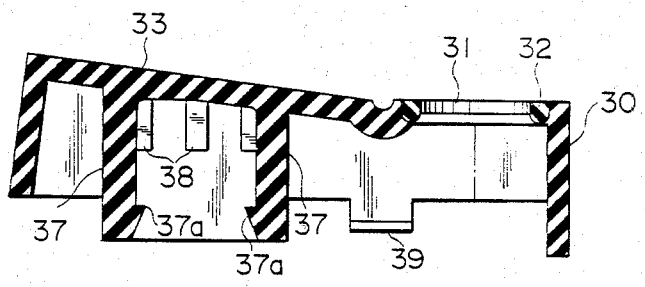
FIG. 6 is a sectional side view of a key top which is employed in the switch of FIG. 1.
Figure 7:
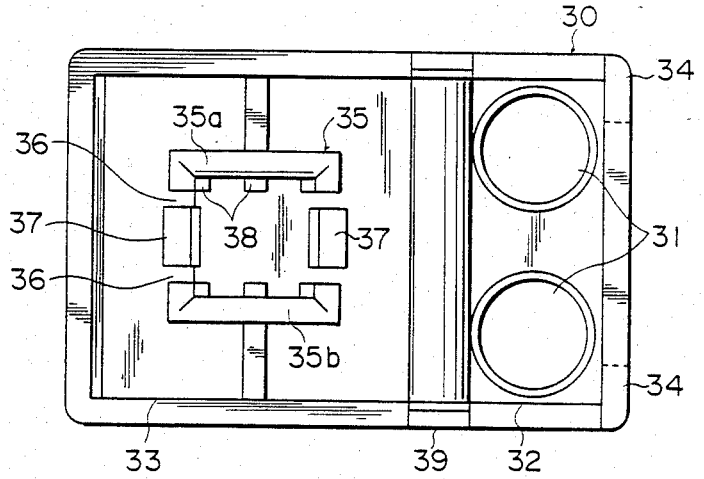
FIG. 7 is a bottom plan view of the key top of FIG. 6.

In FIGS. 6 and 7, there is shown the key top 30 of a bottom-opened boxed shape, which is divided into a display portion 32 and an actuator portion 33. The display portion 32 is provided with a pair of holes 31 for engagement with tops of the LEDs 41. The actuator portion 33 is formed to allow bending backward with respect to the display portion 32.

Since the holes 31 should be formed in accordance with the number of the LEDs 41 mounted on the holder 20, key tops 30 having one and two holes 31 are required to be produced separately.

Figure 2:
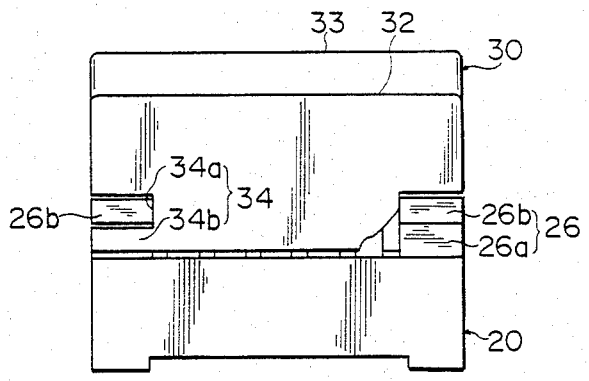
FIG. 2 is a rear elevation view of the switch and is viewed in an arrow mark A of FIG. 1.

As shown in FIGS. 2 and 8, the key top 30 at a lower portion of an end wall thereof includes a pair of openings or engaging portions 34 each having a recessed portion 34*a* and a projecting portion 34*b* which horizontally come into engagement with projections 26*b* and grooves 26*a* of the corresponding engaging portions 26 of the holder 20 so that the key top 30 is engaged with the holder 20 for vertical swing movement.

Figure 3:
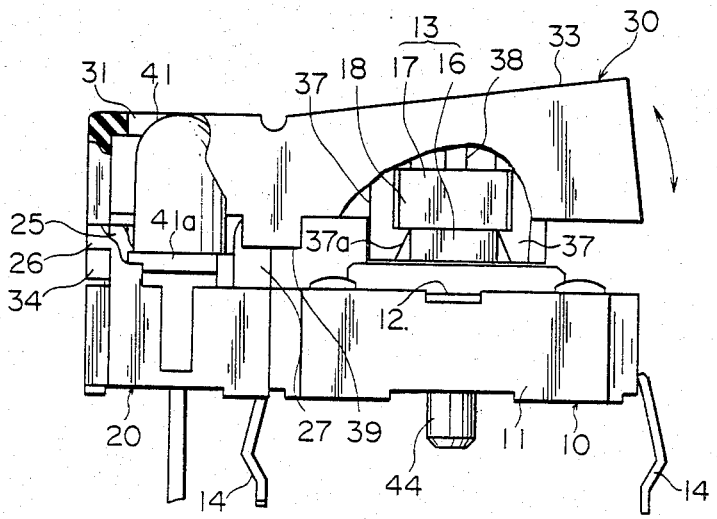
FIG. 3 is a side view of the switch with a partial wall of the key top removed.

Below the actuator portion 33 at a center thereof there is formed a short ring-shaped projecting wall 35 including a pair of wall portions 35*b* and a pair of clasps 37 which are separated by slits 36. The clasps 37 at lower ends thereof are provided with hooks 37*a*. The projecting wall 35 further includes posts 38 at each inner corner and predetermined portions of the wall 35, all of which are formed as a single unit. The posts 38 represent as a spacer within the wall 35 for engagement with the push button 13. As the engaging portions 34 of the key top 30 have been engaged with the engaging portions 26 of the holder 20, the projecting wall 35 confronts the head portion 17 of the push button 13. Then, when the actuator portion 33 has been strongly pushed down, the ring wall 35 covers the head portion 17 of the push button 13 for engagement therewith as illustrated in FIG. 3. The hooks 37*a* of the clasps 37 are engaged with the step portion 18 of the push button 13, and a top surface of the button 13 comes into contact with the posts 38, whereby the key top is fixed to the button in position.

The key top 30 at both side walls thereof further includes tongues 39 extending downwardly, inner wall surfaces of which are guided by the posts 27 on the holder 20.

The above-mentioned components of switching body 10, holder 20 and key top 30 as viewed in FIG. 8 are assembled in the following steps;

First of all, the holder 20 into which LEDs 41 have been inserted is coupled to the switching body 10 by engagement of the projections 21 of the holder with the grooves 15 of the switching body. Then, the engaging portions 34 of the key top 30 are hooked by the engaging portions 26 of the holder 20, and the projecting wall 35 is coupled with the head portion 17 of the push button 13 so that the nails 37 come into contact with the step portion 18.

In this assembled push button switch 40 as viewed in FIGS. 1 and 3, the depression to the actuator portion 33 of the key top 30 by a finger of an operator forces the push button 13 coupled to the switching body 10 to move downwards so that within the body 10 the domed spring plate 53 (see FIG. 5) is deformed providing a snap action to make connection between stationary contact portions 51 and 52. Upon releasing the depression to the actuator portion 33, the push button 13 is pushed up by the resilient resetting force of the spring plate 53 so that the key top 30 is reset to its original position. Thus, the key top 30 vertically swings with respect to the coupling portion with the holder 20, viz. the engaging portions 26 and 34. The swing travel at the actuator portion 33 is designed to be about 0.3 to 0.5 mm.

The switching body 10 of this embodiment is provided with the grooves 15 on either side walls thereof for engagement with the projections 21 of the holder 20, so that the holder 20 may be engaged with the grooves 15 in its opposite direction. Since there are disposed four terminals 14 in the switching body 10, the peripheral circuits connected to the body 10 are easy to be designed. One or two LEDs 41 may be installed into the holder 20, so that the holder 20 is not necessary to be produced separately for the installation of one and two LEDs.

It should be understood that projections and grooves oppositely may be disposed on the basic switching body 10 and the holder 20 for engagement therebetween, or that clasps and openings engaged therewith oppositely may be disposed on the top key 30 and the holder 20 for engagement therebetween.

Since the push button switch of this embodiment is composed with three components of a switching body, a holder and a key top which are joined together by engaging portions disposed on the respective confronting side walls thereof, the switch can have the same width as those of the switching body and the holder, and is easily to be miniaturized. The key top swings with respect to one end thereof hooked by one end of the holder, so that a long mechanical life of the engaging portions between the top key and the holder is easily to be ensured and the switch is advantageously designed to maximize swing travel of the key top.

The switching body is not limited to the switch having the domed spring plate in the above embodiment, and may be any type of switch having a reset spring mechanism.

It should be understood that the above description is merely illustrative of this invention and that many changes and modifications may be made by those skilled in the art without departing from the scope of the appended claims.

What is claimed is:

1. A push button switch assembly comprising a switching body having a push button actuating a switching mechanism therein, a holder located at one end wall of said switching body, and a key top swingably supported by the holder for actuating said push button, said switching body having a means for engaging said holder on an end wall thereof, said holder having at first means for engaging on an end wall of said switching body and a second means for engaging said key top on an opposite end wall thereof, wherein said switching body and said holder are located side-by-side during engagement, said key top on an end wall thereof including an engaging portion to be removably and swingably engaged with said second engaging portion of the holder, and wherein said holder second means for engaging engages said key top engaging portion and wherein said key top lies above said switching body and said holder.

2. A push button switch according to claim 1 wherein each of said switching body, said holder and said key top is of generally boxed shape.

3. A push button switch according to claim 1 wherein said key top on a lower surface thereof is provided with an engaging portion to be fitted to a head portion of said push button.

4. A push button switch according to claim 1 wherein said switching body and said holder are slidably engaged with one after another in a projection-and-groove relationship.

5. A push button switch according to claim 1, wherein said key top and said holder are hinged together.

6. A push button switch according to claim 1, wherein said holder further includes a supporting member for supporting a light emitting member and said key top is provided with an opening engaged with said light emitting member at a head portion thereof.

* * * * *